US005392684A

United States Patent [19]

Renfro et al.

[11] Patent Number: 5,392,684

[45] Date of Patent: Feb. 28, 1995

[54] EXPLOSIVE THRUST-PRODUCING COUPLING

[75] Inventors: Steven L. Renfro, Windsor Locks; Steven G. Wassell, West Hartford, both of Conn.

[73] Assignee: The Ensign-Bickford Company, Simsbury, Conn.

[21] Appl. No.: 82,613

[22] Filed: Jun. 25, 1993

[51] Int. Cl.[6] ..... F42B 15/38

[52] U.S. Cl. ..... 89/1.14; 102/378

[58] Field of Search ..... 89/1.14; 102/378; 60/632, 636

[56] References Cited

U.S. PATENT DOCUMENTS

| | | | |
|---|---|---|---|
| 3,362,290 | 1/1968 | Carr et al. | 89/1.14 |
| 3,486,410 | 4/1968 | Drexelius et al. | 89/1.14 |
| 4,685,376 | 8/1987 | Noel et al. | 89/1.14 |
| 4,879,941 | 11/1989 | Repé et al. | 89/1.14 |
| 5,109,749 | 5/1992 | Olcer | 89/1.14 |
| 5,129,306 | 7/1992 | Fauvel | 102/378 |

OTHER PUBLICATIONS

Noel, Vincent, "Sure-SEP" Separation System, McDonnell Douglas Space Systems Company, #MDC H5185, Oct. 1989.

Lake, E. Raymond, Confined Explosive Separation System, McDonnell Aircraft Company, #MDC 69-021, Jun. 1969.

*Primary Examiner*—David Brown

*Attorney, Agent, or Firm*—Victor E. Libert; Frederick A. Spaeth

[57] ABSTRACT

A separation device (23*a*–23*d*) comprises a frangible joint (24*a*–24*d*) comprising joinder flanges (27*a*, 27*b*) interconnected by walls (126*a*, 126*b*, 226*a*, 226*b*, 326*a*, 326*b*, 426*a*, 426*b*) having fracture grooves (28*a*, 28*b*) and defining a channel (36*a*–36*c*) therein. Within the channel (36*a*–36*c*) is disposed an expansion member (10, 10*a*, 10*b*) containing a detonation charge (16) and having expansion regions (34*a*–34*c*, 134*a*, 134*b*) that expand upon detonation of the charge (16). The expansion region bears against walls at the junctions (32*a*, 32*b*, 32*b*', 132*a*, 132*b*, 232*a*, 232*b*) thereof with joinder flanges (27*a*, 27*b*) to provide separation thrust as well as causing frangible joint (24*a*–24*d*) to fracture at fracture grooves (28*a*, 28*b*).

10 Claims, 3 Drawing Sheets

EXPLOSIVE THRUST-PRODUCING COUPLING

BACKGROUND OF THE INVENTION

1. Field of the Invention

This invention relates to separation devices and more specifically, to explosive couplings.

Separation devices are used when it is desired to effect a separation of two structures that were previously adjoined to one another. Such devices typically join the structures to be separated but are later severed to release the structures from one another. A linear explosive charge, such as a mild detonating fuse, is disposed along the separation line, which may be designed to have a vulnerability to the detonation of the fuse. When separation is desired, the fuse is detonated, rupturing the device and thus allowing the structures to separate. A common application for such a separation device is in the aerospace industry, for the separation of rocket stages or for the release of payloads from cargo holds.

2. Related Art

U.S. Pat. No. 3,486,410 to Drexelius et al, dated Dec. 30, 1969, discloses a conventional separation device comprising an expansion member comprising a detonating cord 18 disposed within a containment tube 22 where it is retained therein by support member 20. The expansion member is disposed about the perimeter of a panel 12 (FIG. 1) that is to be jettisoned from structure 10 by severing the panel therefrom along a groove 62. The explosive detonating cord is coupled to a detonator through a threaded coupling, so that it is necessary that a threaded member 50 be sealably attached to tube 22. Further, an end booster is connected to the end of cord 18 (column 4, lines 17–38). The initiator also contains an explosive detonator 42 that includes a bridge wire, whereby the detonator is electrically initiated. The containment tube has a conventionally flattened configuration so that detonation of the cord therein causes pronounced expansion of the tube in a sideways direction. Upon detonation of cord 18, the expansion member expands, fracturing panel 12 along groove 62 due to the sideways expansion resulting from detonation.

SUMMARY OF THE INVENTION

The present invention provides a separation device for separably joining two structures, comprising a frangible joint comprising at least two joinder flanges, there being a joinder flange for each structure to be separably joined. There is a fracture region connecting the joinder flanges, the fracture region comprising frangible walls comprising fracture grooves. The walls interconnect the joinder flanges and form junctions therewith and define a channel in the fracture region. The device further comprises an expansion member disposed in the channel of the fracture region. The expansion member is dimensioned and configured to reside in substantial surface contact with the channel walls and comprises a containment tube within which is disposed a charge holder that holds a detonation charge. The expansion member is dimensioned and configured to have expansion regions that exert outward pressure on the channel wall upon detonation of the detonation charge, and there is an expansion region proximate to each fracture groove. The channel and the expansion member are dimensioned and configured so that the expansion member has an expansion region proximate to a wall junction to provide separation thrust upon detonation of the detonation charge.

According to one aspect of the invention, at least a first junction may be a wall-supporting junction dimensioned and configured to inhibit wall fracture or deformation proximately to a first joinder flange.

According to another aspect of the invention, at least one junction may be a yielding junction having fracture grooves disposed proximately thereto.

According to still another aspect of the invention, the channel in the fracture region may have a generally triangular cross-sectional configuration, and an apex of the triangle may be disposed proximately to a first junction while the base of the triangle opposing the apex may be disposed proximately to a second junction. Optionally, the first junction may be a wall-supporting junction and the fracture grooves may be disposed proximately to the second junction, whereby the expansion region proximate to the second junction may serve to fracture the channel walls and to provide separation thrust. Preferably, the detonation charge is disposed proximately to the second junction.

According to yet another aspect of the invention, the second junction may be a wall-supporting junction and the sides of the triangle adjacent to the apex may comprise the fracture grooves.

Still another aspect of the invention may provide that the channel in the fracture region may have a generally oblong cross-sectional configuration having a major axis and a minor axis, and the wall junctions may be disposed in diametric opposition along the minor axis of the channel.

Optionally, each junction may be a wall-supporting junction and the channel and the expansion member may be further dimensioned and configured to dispose an expansion region proximately to each fracture groove. In one such embodiment, the channel and expansion member may have a generally rectangular cross-sectional configuration having two pairs of parallel sides constituting expansion regions, one pair of sides being disposed proximately to the junctions and the other pair of sides being disposed proximately to the channel walls.

As used herein, the terms "proximate", "proximately to" or "in proximal relation", when used to describe the relative positioning of an expansion region and a junction or a fracture groove, is intended to mean that upon detonation, the expansion member will provide an effective force on the proximal groove or junction, to effect separation thrust or wall fracture, as appropriate.

BRIEF DESCRIPTION OF THE DRAWINGS

FIGS. 1A, 1B and 1C represent conventional features of the prior art, in which FIG. 1A is a cross-sectional view of a conventional expansion member;

FIG. 1B is a partially cross-sectional view of a separation device including the expansion member of FIG. 1A;

FIG. 1C is a view similar to that of FIG. 1B of the separation device of FIG. 1B after detonation, showing fracture of the separation device;

DETAILED DESCRIPTION OF THE PREFERRED EMBODIMENT

The present invention relates to a separation device comprising an expansion member disposed within a frangible joint. The frangible joint comprises a pair of joinder flanges interconnected by a fracture region. Before separation, the joinder flanges are secured to respective structures, e.g., a fairing or a field joint adapter on a rocket, missile or payload platform, that are to be separated, and the fracture region keeps the assembly together. Typically, the fracture region comprises walls which define a channel within which is disposed the expansion member. The fracture region usually has a groove disposed along the channel to provide a fracture seam. The expansion member comprises a deformable containment tube within which an elastomeric charge holder supports a detonation charge, typically a mild detonation fuse. Upon detonation., the charge causes the expansion tube to expand and fracture the walls of the fracture region along the groove, thus separating the joinder flanges and their associated structures. The containment tube prevents the release of shrapnel and of chemical by-products of the detonation of the charge in the expansion member, thus preventing damage to the structures or objects therein from shrapnel or other detonation by-products. Such separation devices find utility in aerospace applications, particularly in the release of rocket stages, the opening of cargo holds, and/or the release payloads.

Figure 1B:
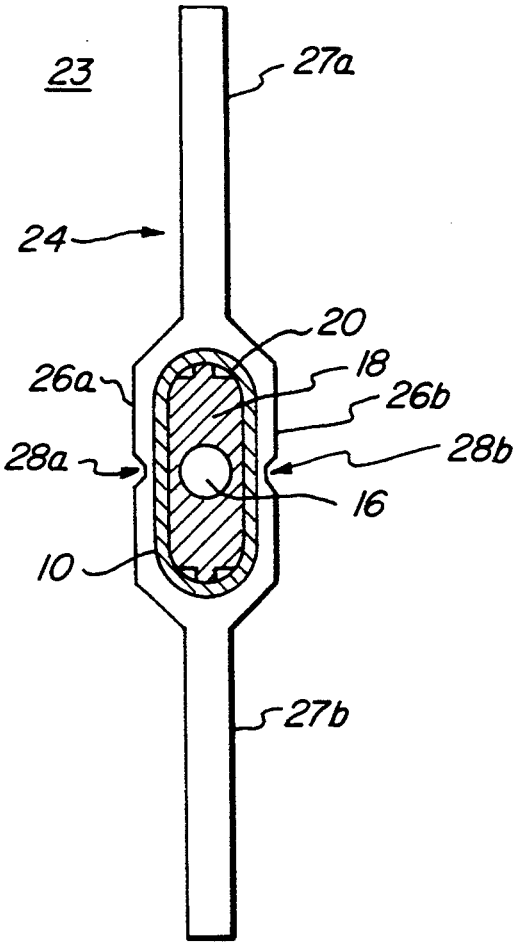
FIG. 1B (PRIOR ART)
Figure 1C:
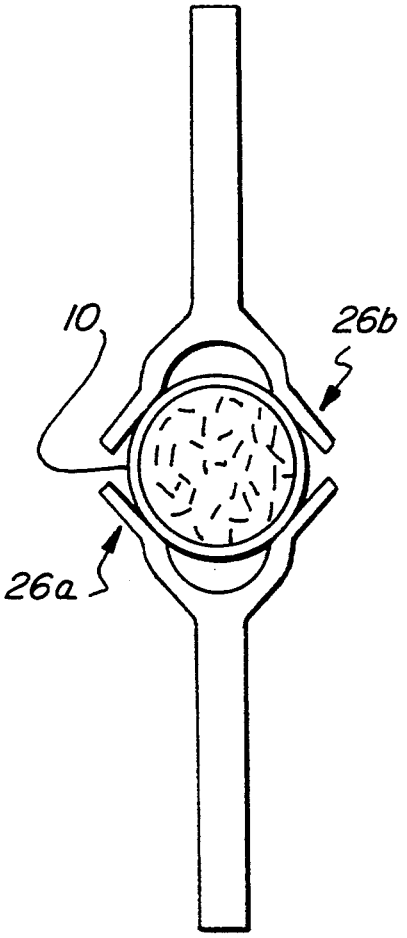
FIG. 1C (PRIOR ART)
Figure 1A:
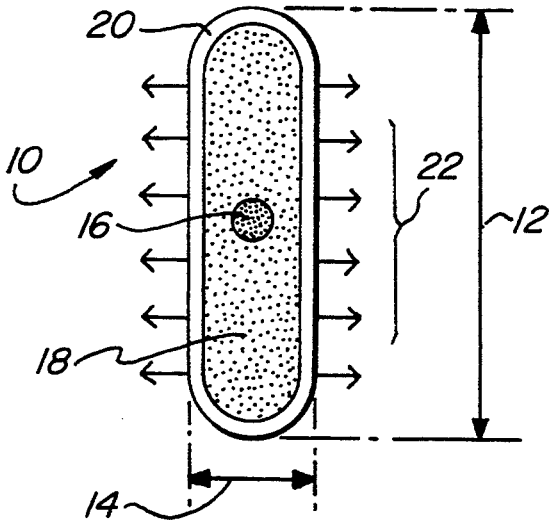
FIG. 1A (PRIOR ART)

There is shown in FIG. 1A a cross-sectional view of a conventional expansion member 10 having an oblong configuration characterized by a major axis 12 and a minor axis 14. Expansion member 10 comprises a containment tube 20 that is typically formed by flattening round tubing. Within containment tube 20 is an elastomeric charge holder 18 within which is disposed a linear detonatable charge such as a mild detonation fuse 16. One suitable charge is a mild detonation fuse known under the designation HNS-IIA Mild Detonating Fuse. Such a fuse typically contains a core of 24 grains per linear foot HNS in an aluminum jacket. However, it will be appreciated that other detonation materials such as HMX can be used as well. The elastomeric charge holder 18 is commonly made from a silicone polymer.

Upon detonation of mild detonation fuse 16, containment tube 20 expands most prominently along its minor axis, as indicated by expansion arrows 22. Containment tube 20 is made of a material like stainless steel that is sufficiently flexible to allow for the expansion as indicated by expansion arrows 22, but is also strong enough not to fracture or be perforated by shrapnel released by fuse 16, to completely contain the debris released upon detonation of fuse 16.

A separation device 23 representative of the prior art is shown in cross section in FIG. 1B, in which expansion member 10 is disposed within a frangible joint 24 which may be an extruded aluminum member having a fracture region comprising separation walls **26*a*, 26*b* defining an internal channel for receiving expansion member 10. Frangible joint 24 comprises joinder flanges 27*a*, 27*b* mounted to the fracture region for attachment to the structures to be separably attached. Thus, prior to separation, frangible joint 24 functions like a butt plate. Generally, the expansion member 10 is inserted lengthwise into the channel formed in the frangible joint. Walls 26*a*, 26*b* have fracture grooves 28*a*, 28*b* that are designed to provide a clean fracture of walls 26*a*, 26*b* in response to expansion of the expansion member 10 upon detonation of fuse 16, whereupon expansion member 10 will expand laterally to a substantially circular cross-sectional configuration as shown in FIG. 1C, thus fracturing walls 26*a* and 26*b* along the length of the separation device. Thus, joinder flanges 27*a*, 27*b*** and their associated structures are separated upon detonation of the detonation fuse.

The function of a separation device according to the prior art, as represented by the transition from FIG. 1B to FIG. 1C depends upon the expansion of the expansion member in a direction that causes it to bear against the fracture grooves **28*a*, 28*b* to fracture walls 26*a*, 26*b*. This results from an expansion of the containment tube 20 as indicated by arrows 22. However, this degree of expansion does not occur uniformly about containment tube 20; the rounded ends of the tube at the top and bottom of FIG. 1A contract, rather than expand, along the major axis 12 of the tube in response to detonation of fuse 16. Because the rounded ends of containment tube 20 were in contact with the junction of walls 26*a*, 26*b* and joinder flanges 27*a* and 27*b* before the detonation of fuse 16, but contract therefrom upon detonation, the detonation of fuse 16 produces little if any force tending to separate joinder flanges 27*a* and 27*b* and their associated structures. Although U.S. Pat. No. 3,486,410 shows an expansion member disposed so that the expansion portion produces a thrust that jettisons panel 12 from base structure 10, the orientation of the expansion member has not hereto been utilized to provide separation thrust with separation devices having joinder flanges, or in the separation of structures in a direction generally parallel to the surfaces thereof. U.S. Pat. No. 3,486,410 shows the jettison of panel 12** in a direction generally perpendicular to the surface of the panel, not parallel to it.

Since conventional separation devices as shown in FIG. 1B do not provide separation thrust, it is common to provide distinct separation thrusters whose actions are coordinated with the actuation of the separating device.

The present invention serves to reduce or eliminate the need for a distinct separation thruster by providing a separation device that produces separation thrust.

Generally, in accordance with the present invention, the expansion member of a separation device comprising two or more joinder flanges is dimensioned and configured so that an expansion region is disposed proximately to a fracture groove in the fracture region of the device, but an expansion region is also disposed proximately to at least one junction of the fracture region walls and a joinder flange. Thus, upon detonation of the detonation fuse in the expansion member, substantial force will not only be exerted against the frangible wall of the fracture region of the separation device, but also against the joinder flanges in a direction that tends to separate one flange from another. As will be discussed below, in some embodiments according to the present invention, a single expansion portion may serve both functions; in other embodiments, distinct expansion portions may fracture the frangible walls of the fracture region while another one or more expansion portions provide separation thrust.

Figure 2:
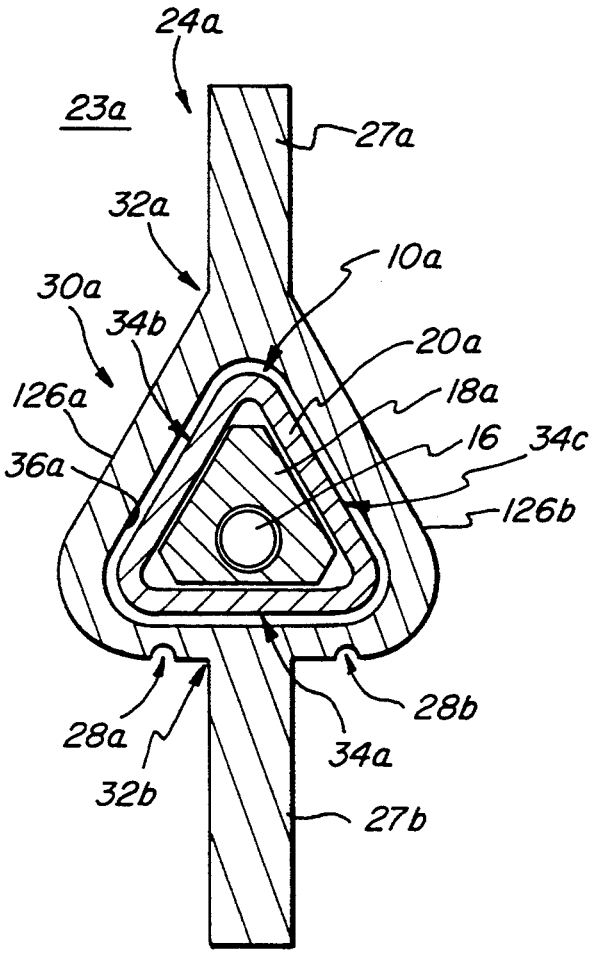
FIGS. 2–5 are schematic cross-sectional views of separation devices according to the present invention, each showing an expansion member having an expansion region disposed in proximal relation to a wall-joinder flange junction.

Accordingly, a separation device according to one embodiment of the present invention is shown in FIG. 2 where separation device **23*a* comprises a frangible joint 24*a* having a fracture region 30*a* and joinder flanges 27*a* and 27*b* that are both attached to fracture region 30*a***.

Fracture region 30a comprises frangible walls 126a and 126b which extend from junction 32a to junction 32b, where they meet with joinder flanges 27a and 27b, respectively. Walls 126a and 126b cooperate to define a channel 36a which, in the cross-sectional view of FIG. 2, has a substantially triangular configuration. Accordingly, expansion member 10a disposed therein also has a substantially triangular cross-sectional configuration so that the outer surface of the containment tube 20a is substantially in contact with the inner wall of channel 36a. (A gap is shown between the exterior of containment tube 20a and the interior of channel 36a for purposes of illustration only.) Expansion member 10a also comprises a charge holder 18a within which is disposed a detonation charge which, in the illustrated embodiment, is a mild detonation fuse 16. The edges of charge holder 18a are chamfered to facilitate insertion of charge holder 18a into containment tube 20a.

Due to its substantially triangular configuration, expansion member 10a has three substantially straight sides which will serve as expansion regions 34a, 34b, 34c which will be deformed outwardly toward the inner wall of channel 36a when fuse 16 is detonated. Expansion region 34a is disposed proximately to junction 32b where joinder flange 27b connects to walls 126a and 126b. Fracture grooves 28a and 28b are disposed in proximal relation to junction 32b, and thus in proximal relation to expansion region 34a, so that upon detonation of fuse 16, expansion member 10a will fracture walls 126a and 126b of grooves 28a and 28b and will also exert pressure against junction 32b, thus providing a separation thrust that will cause joinder flange 27b and its associated structure to separate from joinder flange 27a and its associated structure. Since fracture grooves 28a and 28b are disposed in proximity to junction 32b, it may be referred to as a "yielding junction". Advantageously, charge holder 18a is configured to dispose fuse 16 at a point closer to the yielding junction than the center of channel 36a. In embodiments not comprising a yielding junction, fuse 16 is generally disposed centrally within the channel.

It is not necessary for fracture grooves 28a and 28b to be disposed proximately to a wall-joinder flange junction as shown in FIG. 2. For example, in an alternative embodiment seen in FIG. 3, expansion region 34a is disposed in proximal relation to junction 32b'. However, expansion region 34a does not serve to fracture grooves 28a and 28b, since these are disposed in proximal relation to the two other expansion regions, 34b and 34c, respectively. Junction 32b' is designed with increased thickness to provide support to walls 226a and 226b in the region of joinder flange 27b. Thus, junction 32b', which may be referred to as a wall-supporting junction, serves to strengthen or reinforce walls 226a and 226b and thus prevent deformation and fracture in the region near joinder flange 27b. Accordingly, the separation thrust provided by expansion region 34a will not be diffused by causing deformation of walls 226a and 226b in the region around junction 32b'.

Figure 4:
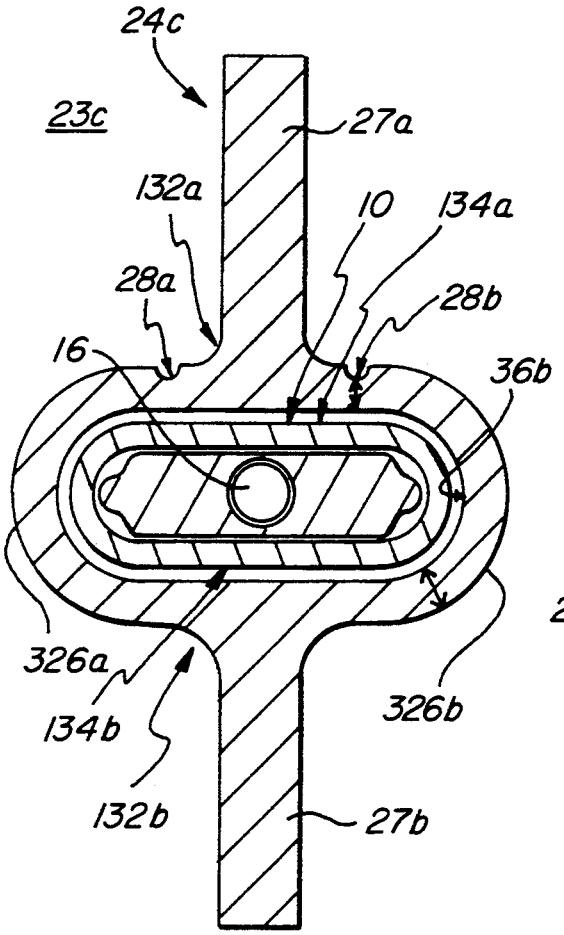

Still another embodiment of the present invention is seen in FIG. 4, where a conventional, flattened tube-type expansion member 10 is disposed within channel 36b in an orientation such that junctions 132a and 132b are disposed in diametric opposition along the minor axis of expansion member 10. In such a configuration, each of expansion regions 134a and 134b are disposed in proximity to junctions 132a and 132b, respectively. Advantageously, grooves 28a and 28b are disposed in proximity to expansion region 134a, i.e., in proximal relation to junction 132a, rather than being disposed half-way between junctions 132a and 132b, as would be suggested by, e.g., FIG. 1B. Thus, junction 132a is a yielding junction. Upon detonation of fuse 16, walls 326a and 326b will fracture at fracture grooves 28a and 28b and expansion region 134a will provide separation thrust for separating joinder flanges 27a and 27b.

The configuration of FIG. 4 may, in a longitudinal direction perpendicular to the plane of the Figure, be limited to separation devices that are either straight or that have a relatively large radial curve; it has been found that due to the relatively long major axis of the fracture region, the curvature of separation device 23c must be limited to avoid undue strain in the frangible joint 24c.

Figure 3:
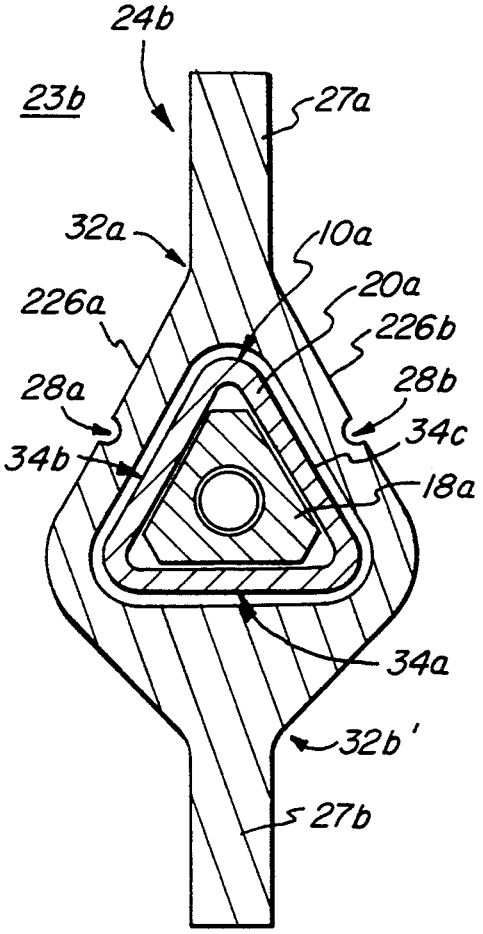
Figure 5:
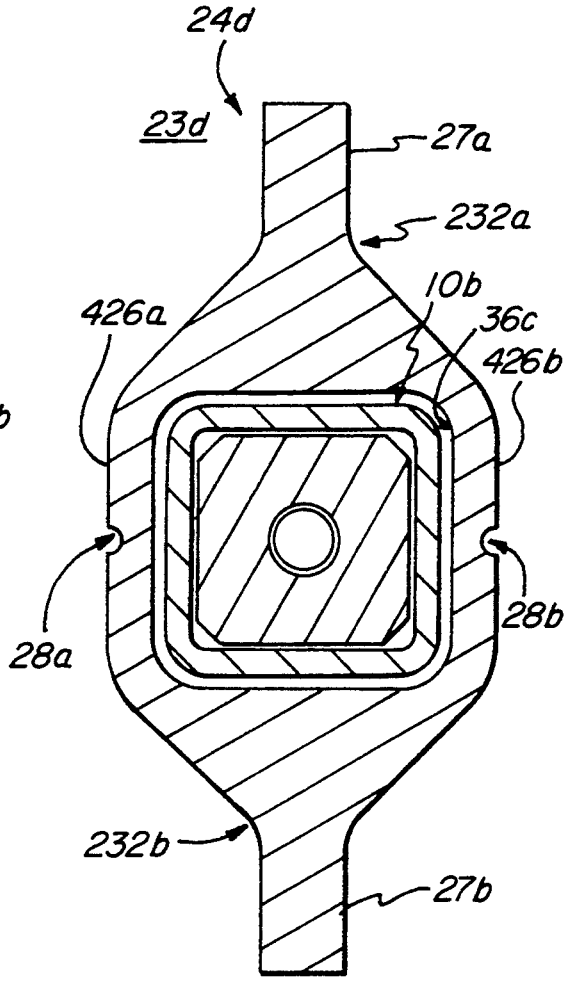

Still another embodiment of the invention is seen in FIG. 5, wherein both junctions 232a and 232b are support junctions, as was junction 32b' of FIG. 3, i.e., these junctions tend to prevent fracture or wall deformation in the region proximal to their respective joinder flanges 27a and 27b. Channel 36c and expansion member 10b may have respective rectangular cross-sectional configurations. Although in the embodiment of FIG. 5, the rectangular configuration is substantially square, it will be appreciated that other species of rectangles may also be employed. Expansion member 10b has four expansion regions, two of which are parallel and are associated with fracture grooves 28a and 28b for providing a sideways fracture force similar to those illustrated in FIGS. 1A, 1B and 1C. However, expansion member 10b also has two parallel expansion regions disposed in proximity to junctions 232a and 232b, to provide separation thrust when walls 426a and 426b are fractured.

One aspect of the present invention relates to a method for assembling an expansion member that is disposed in the channel in the separation device. As described above, the expansion member comprises a containment tube within which is disposed a charge holder for supporting a detonation charge, e.g., a mild detonation fuse. Conventionally, the containment tube is a flattened steel tube and the charge holder is typically formed from a silicone polymer.

The charge holder is formed with a longitudinal internal bore for receiving the detonation fuse. In accordance with the present invention, the bore of the charge holder is pressurized with air or another suitable gas, e.g., nitrogen, causing the holder and the bore therein to inflate or expand. The bore, which is configured to snugly engage the detonation fuse in the un-inflated condition, is thus inflated to a dimension for which insertion of the detonation fuse is easily accomplished.

The charge holder is dimensioned and configured to fit snugly within the interior of the containment tube. Therefore, it may be difficult to insert the charge holder into the containment tube. To facilitate this process, the present invention provides that the charge holder be cooled to cause it to contract. Then, with the charge holder in the contracted state, it is inserted into the containment tube. To further facilitate the insertion of the charge holder into the containment tube, it is preferred to apply a dry lubricant on the surface of the charge holder. One suitable lubricant is talcum powder; other lubricants will occur to those skilled in the art.

While the invention has been described in detail with respect to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A separation device for separably joining two structures, comprising:

a frangible joint comprising at least two joinder flanges, there being a joinder flange for each structure to be separably joined and a fracture region connecting the joinder flanges, the fracture region comprising frangible walls comprising fracture grooves, the walls interconnecting the joinder flanges and forming junctions therewith and defining a channel in the fracture region; and an expansion member disposed in the channel in substantial surface contact with the channel walls, the expansion member comprising a containment tube, a detonation charge, and a charge holder supporting the detonation charge within the containment tube, the expansion member comprising an expansion region proximate to each fracture groove to exert outward pressure on the channel wall upon detonation of the detonation charge to fracture the channel wall;

there being an expansion region proximate to a wall junction to provide separation thrust upon detonation of the detonation charge.

2. The separation device of claim 1 wherein each junction is a wall-supporting junction and wherein there is an expansion region proximate to each fracture groove.

3. The separation device of claim 2 wherein the channel and expansion member have a generally rectangular cross-sectional configuration having two pairs of parallel sides constituting expansion regions, one pair of sides being disposed proximately to the junctions and the other pair of sides being disposed proximately to the channel walls.

4. The separation device of claim 1 wherein at least a first junction is a wall-supporting junction dimensioned and configured to inhibit wall fracture or deformation proximately to a first joinder flange.

5. The separation device of claim 1 or claim 2 wherein the channel in the fracture region has a generally oblong cross-sectional configuration having a major axis and a minor axis, and wherein the wall junctions are disposed in diametric opposition along the minor axis of the channel.

6. The separation device of claim 1 or claim 2 wherein at least one junction is a yielding junction having fracture grooves disposed proximately thereto.

7. The separation device of claim 6 wherein the channel in the fracture region has a generally triangular cross-sectional configuration and wherein an apex of the triangle is disposed proximately to a first junction and wherein the base of the triangle opposing the apex is disposed proximately to a second junction.

8. The separation device of claim 7 wherein the second junction is a wall-supporting junction and wherein the sides of the triangle adjacent to the apex comprise the fracture grooves.

9. The separation device of claim 7 wherein the first junction is a wall-supporting junction and wherein the fracture grooves are disposed proximately to the second junction, whereby the expansion region proximately to the second junction serves to fracture the channel walls and to provide separation thrust.

10. The separation device of claim 9 wherein the detonation charge is disposed proximately to the second junction.

* * * * *